US006896627B2

(12) United States Patent
Hou

(10) Patent No.: US 6,896,627 B2
(45) Date of Patent: May 24, 2005

(54) GOLF CLUB HEAD AND MANUFACTURING METHOD THEREFOR

(75) Inventor: Wen-Ching Hou, Kaohsiung (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 0 days.

(21) Appl. No.: 10/424,061

(22) Filed: Apr. 28, 2003

(65) Prior Publication Data

US 2004/0214657 A1 Oct. 28, 2004

(51) Int. Cl.[7] ..... A63B 53/04
(52) U.S. Cl. ..... 473/335; 473/349; 473/350
(58) Field of Search ..... 473/324–350, 473/290–292; D21/747–752

(56) References Cited

U.S. PATENT DOCUMENTS 4,326,326 A * 4/1982 MacDonald ..... 29/428
4,355,808 A * 10/1982 Jernigan et al. ..... 473/324
4,852,880 A * 8/1989 Kobayashi ..... 473/349
4,884,812 A * 12/1989 Nagasaki et al. ..... 473/342
4,919,431 A * 4/1990 Antonious ..... 473/350
4,955,610 A * 9/1990 Creighton et al. ..... 473/332
5,104,457 A * 4/1992 Viljoen et al. ..... 473/350
5,242,167 A * 9/1993 Antonious ..... 473/350
5,439,223 A * 8/1995 Kobayashi ..... 473/334
5,593,356 A * 1/1997 Takeda ..... 473/335
5,669,826 A * 9/1997 Chang et al. ..... 473/332
5,707,302 A * 1/1998 Leon et al. ..... 473/324
6,206,790 B1 * 3/2001 Kubica et al. ..... 473/335
6,290,609 B1 * 9/2001 Takeda ..... 473/335

* cited by examiner

*Primary Examiner*—Sebastiano Passaniti
(74) *Attorney, Agent, or Firm*—Bacon & Thomas

(57) ABSTRACT

A golf club head. The golf club head includes a recession on a rear surface of a striking plate. A weight is embedded into the recession. The striking plate is punched or welded on the golf club head to thereby form a gap between a sole plate of the golf club head and the weight combined with the rear surface of the striking plate. The golf club head includes a finishing surface of the striking plate and a surface of the golf club head.

13 Claims, 5 Drawing Sheets

GOLF CLUB HEAD AND MANUFACTURING METHOD THEREFOR

BACKGROUND OF THE INVENTION

1. Field of the Invention

The present invention is related to a golf club head and a manufacturing method therefor. More particularly, the present invention is related to a striking plate of a golf club head forming with a recession, which is adapted to receive various weights rapidly and firmly. The present invention is also related to a golf club head forming with a gap between a sole plate and the weight, thereby increasing coefficient of restitution and elastic deformation of the striking plate.

2. Description of the Related Art

Referring to FIGS. 1 and 2, it illustrates a conventional welding structure of an iron golf club head. A main body 10 is formed with a striking plate 11, an opening 12 and a neck portion 13. The striking plate 11 is provided with a front surface adapted to hit a golf ball, and a rear surface including an annular edge adapted to combine with an annular frame 14 of the main body 10 by welding process. The opening 12 is provided with a space that allows the deformation of a sweet spot of the striking plate 11 while striking a golf ball. The neck portion 13 is adapted to receive an end of a shaft.

FIG. 3 illustrates a conventional embedding structure of another iron golf club head. In assembling operation, an annular edge of the striking plate 11 is incorporated into the main body 10 by force so that a deformation edge 11*a* of the striking plate 11 is formed and embedded in a groove 14*a* of the annular frame 14.

The main body 10 of the golf club head further includes a weight adapted to lower a center of gravity of the golf club head and to lengthen its long-range striking. Generally, the weight is structurally integrated into a rear surface of the striking plate 11 or a sole plate 101 of the main body 10. Changing various specifications of weights for the golf club head according to demand, manufacturer must prepare various specifications of striking plate molds that may increase total manufacture cost. If the design of the weight incorporated into the rear surface of the striking plate 11 is inferior, it has disadvantage of the entire center of gravity of the main body 10, ability of long-range striking and the elastic deformation of the striking plate 11.

The present invention intends to provide a golf club head having a striking plate and a rear surface thereof formed with a recession, which is adapted to combine with an appropriate mount and configuration of a weight. The golf club head of the present invention is further provided with a gap between a sole plate and the weight for spacing apart a predetermined width. Thus, the gap of the golf club head of the present invention accomplishes easy to change the weight in a welding process according to demand in such a way to mitigate and overcome the above problem. Accordingly, the golf club head of the present invention is able to lower a center of gravity, and to increase coefficient of restitution and elastic deformation of the striking plate. Thereby the golf club head of the present invention is suitable for long-range striking and mass production.

SUMMARY OF THE INVENTION

The primary objective of this invention is to provide a golf club head and a manufacturing method therefor, which is formed with a recession adapted to combined with an appropriate amount and configuration of a weight. Thus, various specifications of weights for the golf club head can be changed in a welding or punching process to thereby lower manufacture cost, and to thereby increase throughput and design choice.

The secondary objective of this invention is to provide a golf club head and a manufacturing method therefor, which is formed with a gap between a sole plate and a weight that is regarded as a buffer space to allow elastic deformation. Thus, the golf club head is able to increase coefficient of restitution and elastic deformation of the striking plate, and thereby it is suitable for long-range striking.

The manufacturing method for a golf club head in accordance with the present invention comprises steps of: forming a recession on a rear surface of a striking plate; punching a predetermined specification of a weight to thereby embed it into the recession; punching or welding the striking plate on the golf club head to thereby form a gap between a sole plate of the golf club head and the weight combined with the rear surface of the striking plate; and finishing on a surface of the striking plate and a surface of the golf club head.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
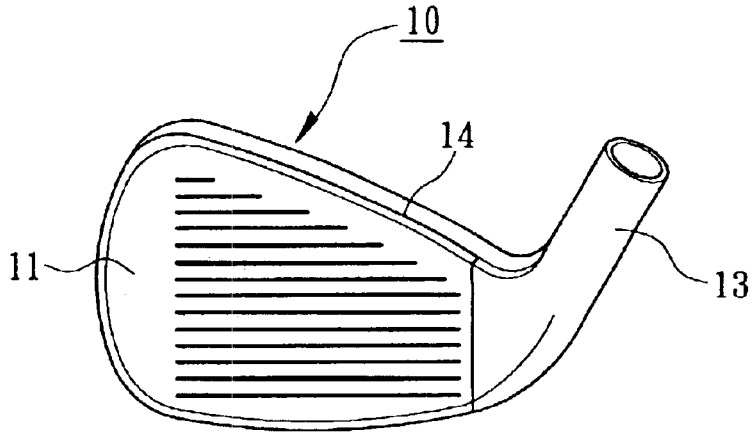
FIG. 1 PRIOR ART
FIG. 1 is a perspective view of an iron golf club head in accordance with the prior art.
Figure 2:
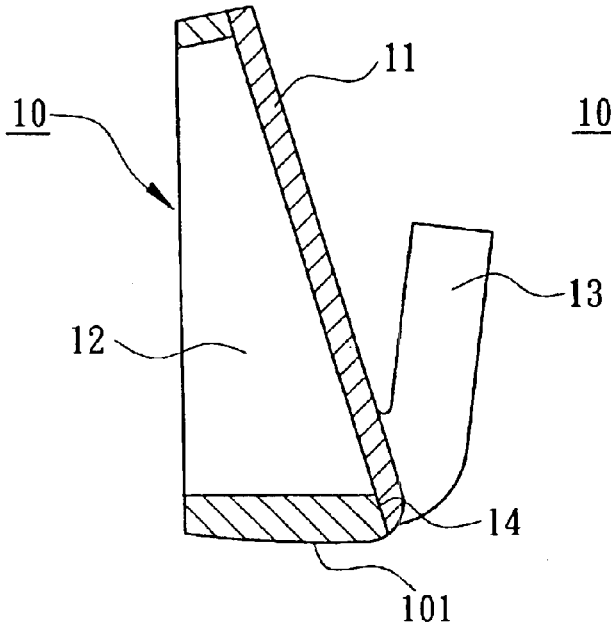
FIG. 2 PRIOR ART
FIG. 2 is a cross-sectional view of an iron golf club head in accordance with the prior art.
Figure 3:
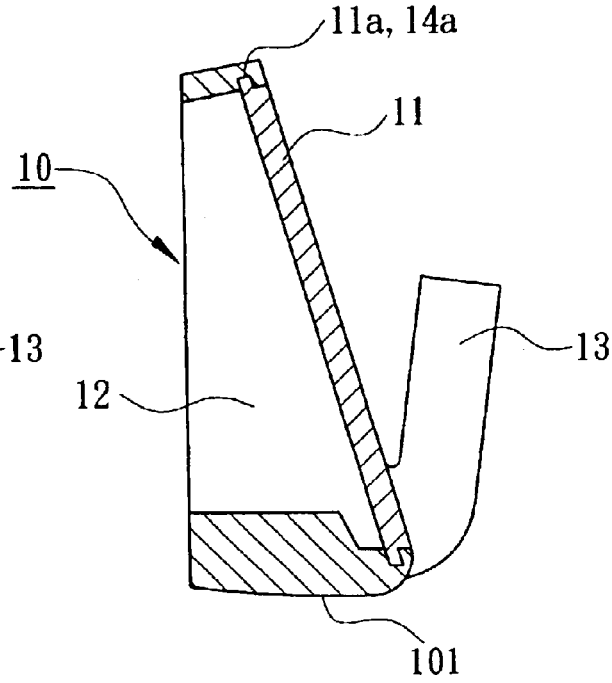
FIG. 3 PRIOR ART
FIG. 3 is a cross-sectional view of an another iron golf club head in accordance with the prior art.
Figure 4:
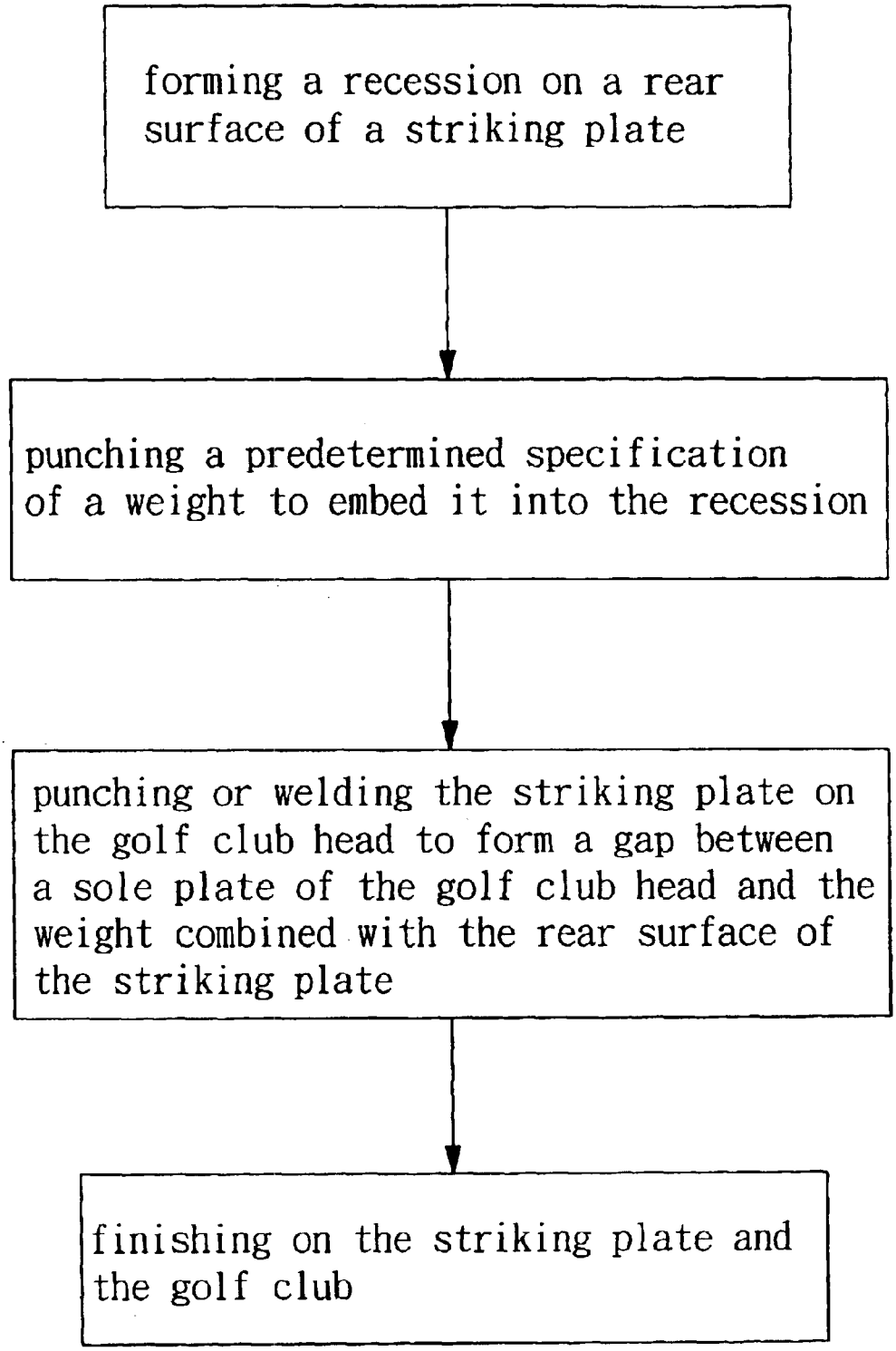
FIG. 4 is a block diagram of a manufacturing method for a golf club head in accordance with a first embodiment of the present invention.
Figure 5:
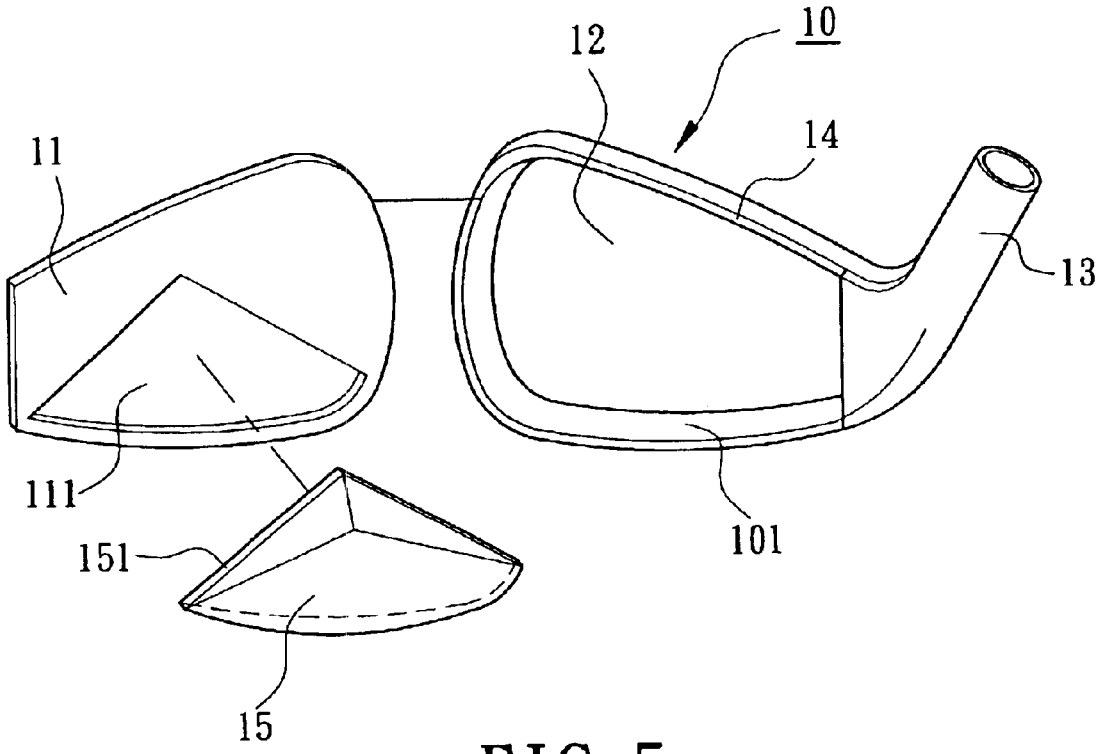
FIG. 5 is an exploded perspective view of a golf club head in accordance with the first embodiment of the present invention.
Figure 6:
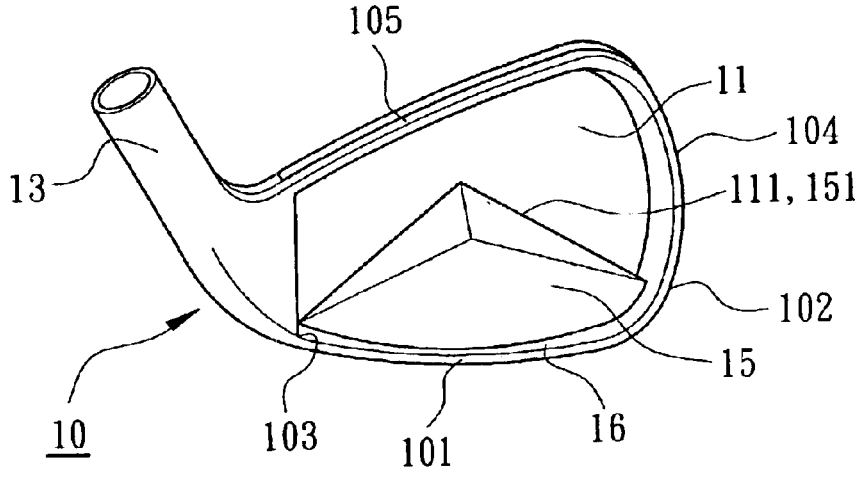
FIG. 6 is a rear perspective view of the golf club head in accordance with the first embodiment of the present invention.

Referring to FIGS. 4 through 12, reference numerals of the first through sixth embodiments of the present invention have applied the identical numerals of the conventional golf club head, as shown in FIGS. 1 through 3. The construction of the golf club head in accordance with the embodiment of the present invention has the similar configuration and same function as that of the conventional golf club head and the detailed descriptions may be omitted.

Referring to FIGS. 4 through 7, a first manufacturing step of the manufacturing method in accordance with the first embodiment of the present invention is forming a recession on a rear surface of a striking plate. The golf club head includes a main body 10 integrated with a striking plate 11, an opening 12, a neck portion 13, a ring frame 14 and a weight 15. The striking plate 11 is combined with a front side of the main body 10, and formed with a recession 111 on its rear surface. Preferably, the bottom edge of the recession 111 is extended along that of the striking plate 11.

Referring to FIGS. 4 through 7, a second manufacturing step of the manufacturing method in accordance with the first embodiment of the present invention is punching a predetermined specification of the weight 15 to thereby embed it into the recession 111 of the striking plate 11. The weight 15 is processed in a casting process or a mechanically cutting process subsequent to the punching operation. The weight 15 includes a maximum thickness proximate its bottom edge corresponding to the bottom edge of the recession 111. The weight 15 further includes an engaging portion 151 adapted to connect to the edge of the recession 111 of the striking plate 11 by means of weld, adhesion or fitting engagement. In welding operation, it can be chosen from argon arc welding, braze welding, laser welding, plasma arc welding, ion beam welding or other high-energy electron beam welding. In adhering operation, the adhesive can be chosen from solvent-release type (e.g. quick-drying adhesive), chemically reactive type (e.g. epoxy resin) and light-sensitive type (e.g. visible-light-sensitive type adhesive or UV-sensitive type adhesive). It can be chosen that configuration, dimensions, weight and material of the weight 15 are changed according to design choice.

As shown in at least FIGS. 7–10, the weight 15 may have greater volume at a bottom portion thereof in comparison to an upper portion thereof, in order to lower the center of gravity of the golf club head.

Figure 10:
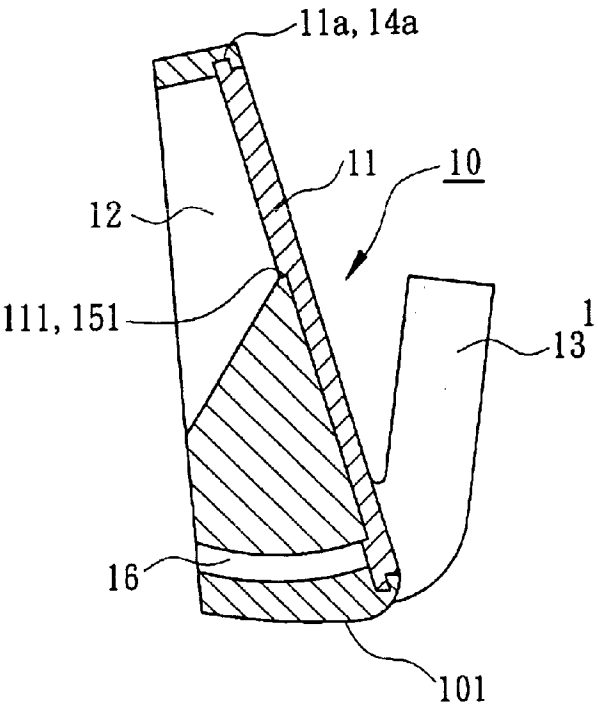
FIG. 10 is a cross-sectional view of a golf club head in accordance with a fourth embodiment of the present invention.

Referring again to FIGS. 4 through 7, a third manufacturing step of the manufacturing method in accordance with the first embodiment of the present invention is punching or welding the striking plate 11 on the main body 10. Thereby, an elongated gap 16 is formed between the sole plate 101 of the main body 10 and the weight 15 combined with the rear surface of the striking plate 11. Subsequently, the rear surface of the striking plate 11 attaches to the ring frame 14 of the main body 10 by argon arc welding, braze welding, laser welding, plasma arc welding, ion beam welding or other high-energy electron beam welding subsequent to integrating with the weight 15. Alternatively, the striking plate 11 is able to attach to the ring frame 14 by punching process, as best shown in FIG. 10.

Referring again to FIGS. 6 and 7, as the striking plate 11 is combined with the ring frame 14 of the main body 10, the maximum thickness of the weight 15 is proximate the sole plate 101 of the main body 10. Then, the elongated gap 16 is located between the weight 15 and the sole plate 101 and spaced apart the weight 15 from the sole plate 101 that it may narrow the size of the connection area. Also, a center striking area of the striking plate 11, which includes a sweet spot, is maximized to obtain the coefficient of restitution and elastic deformation of the striking plate 11. Thereby, the main body 10 is suitable for long-range striking. Meanwhile, the present invention employs the recession 111 adapted to change the weight for various types of the golf club head. Thereby, throughput of the golf club head is suitable for mass production and design choice of the golf club head is increased.

Referring again to FIGS. 4 through 7, a fourth manufacturing step of the manufacturing method in accordance with the first embodiment of the present invention is finishing on a surface of the striking plate 11 and a surface of the main body 10 of the golf club head. Subsequent to assembling the weight 15, the striking plate 11 and the main body 10 the golf club head is in an aging/precipitation heat-treating process to change the lattice of a crystal at the welding portion to thereby increase its structural strength. After that the golf club head is successively in a precision machinery process, a trimming process, a polishing process, a brilliant polishing process, a mirror finishing process, a satin finishing process, a painting process, a laser engraving process, a printing process and a lacquer-coating process (or a protective coating process).

Referring again to FIG. 7, in order to obtain the maximum elastic deformation (coefficient of restitution) and the maximum striking range, the main body 10, the weight 15 and the elongated gap 16 are preferably complied with the following processing conditions:

1. The weight 15 and the elongated gap 16 are commonly extended along the sole plate 101 of the main body 10 from a toe end 102 to a heel end 103;
2. The width (a) of the elongated gap 16 is substantially in a range of 0.5 to 8.0 mm;
3. The maximum thickness (y) of the weight 15 is substantially equal to or greater than 2.5 times of the thickness (x) of the striking plate 11 (i.e. $y \geqq 2.5x$); and
4. A distance y' between the center of gravity of the main body 10 and the sole plate 101 is substantially equal to or less than 20 mm (i.e. $y' \leqq 20$ mm) to thereby lower the center of gravity of the entire golf club head.

Figure 8:
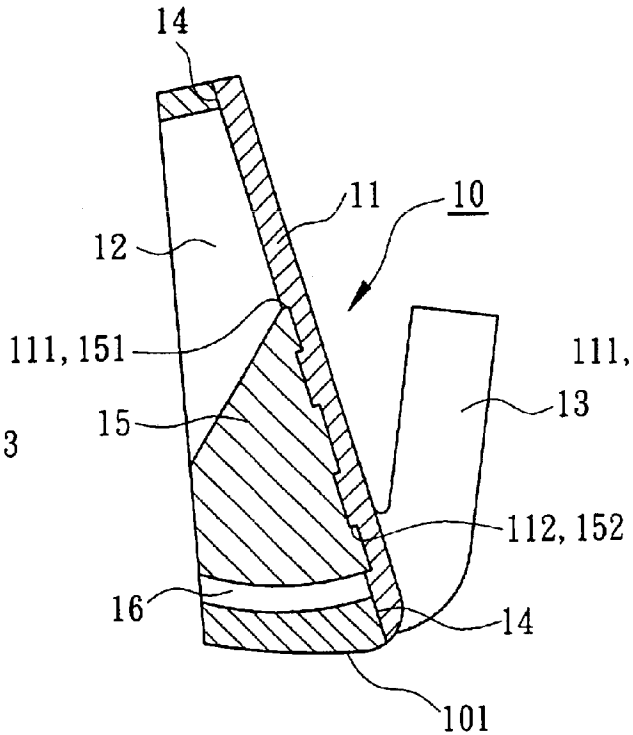
FIG. 8 is a cross-sectional view of a golf club head in accordance with a second embodiment of the present invention.
Figure 7:
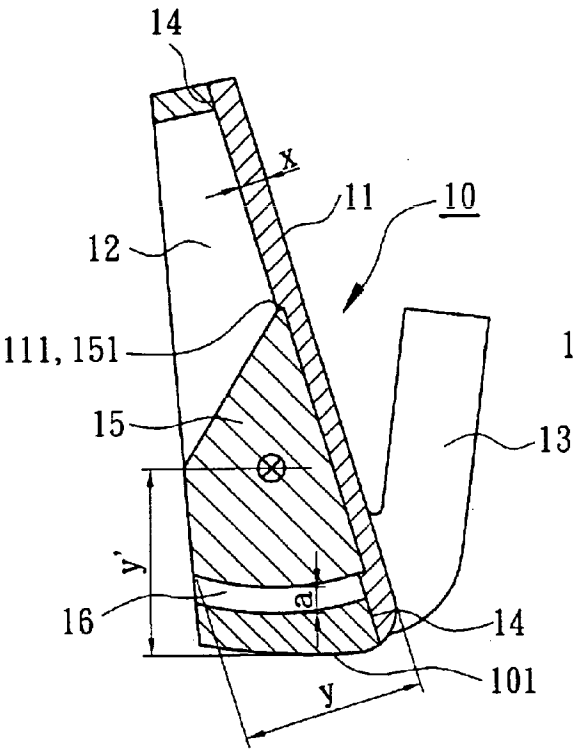
FIG. 7 is a cross-sectional view of the golf club head in accordance with the first embodiment of the present invention.

Referring to FIG. 8, the golf club head in accordance with the second embodiment of the present invention includes a main body 10, a striking plate 11, an opening 12, a neck portion 13, a ring frame 14 and a weight 15. In comparison with the first embodiment, the striking plate 11 of the second embodiment is provided with a recession 111 and at least one protrusion 112 formed therein. Correspondingly, the weight 15 is also provided with an engaging portion 151 and at least one groove 152. In addition to the engagement of the engaging portion 151 with the recession 111, the engagement of the groove 152 with protrusion 112 is adapted to provide an additional force when assembled. Preferably, the protrusion 112 and the groove 152 can be designed in various configurations, engaging manners and dimensions.

Figure 9:
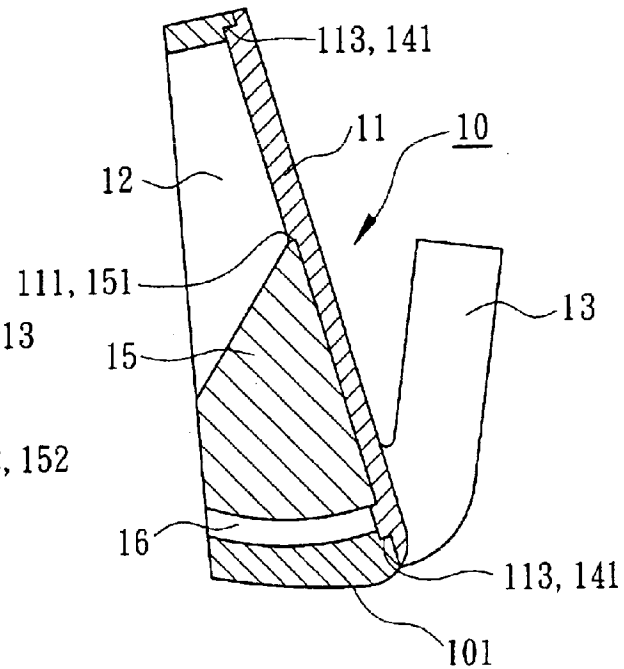
FIG. 9 is a cross-sectional view of a golf club head in accordance with a third embodiment of the present invention.

Referring to FIG. 9, the golf club head in accordance with the third embodiment of the present invention includes a main body 10, a striking plate 11, an opening 12, a neck portion 13, a ring frame 14 and a weight 15. In comparison with the second embodiment, the ring frame 14 of the third embodiment is provided with a stepped portion 141. Correspondingly, the striking plate 11 is provided with a complementary stepped portion 113. Thus, the engagement of the stepped portion 141 of the ring frame 14 with the complementary stepped portion 113 of the striking plate 11 may increase a mechanically connected relationship therebetween when assembled. Preferably, the configurations of the stepped portions 113 and 141 can be changed according to design choice.

Referring to FIG. 10, the golf club head in accordance with the fourth embodiment of the present invention includes a main body 10, a striking plate 11, an opening 12, a neck portion 13, a ring frame 14 and a weight 15. In comparison with the first through third embodiments, the ring frame 14 of the fourth embodiment is provided with a plastic-deformable groove 14*a*. Correspondingly, the striking plate 11 is provided with a plastic-deformable edge 11*a*. Thus, the plastic-deformable edge 11*a* of the striking plate 11 is able to embed in the plastic-deformable groove 14*a* when assembled.

Figure 11:
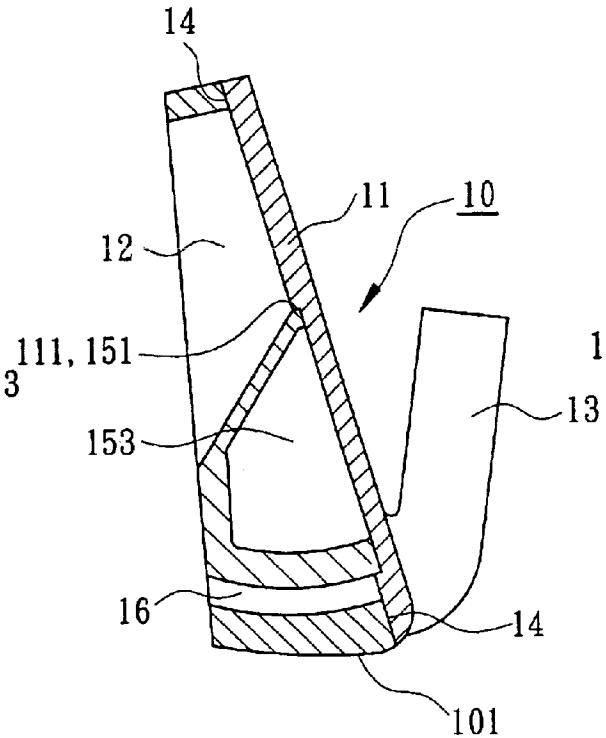
FIG. 11 is a cross-sectional view of a golf club head in accordance with a fifth embodiment of the present invention.

Referring to FIG. 11, the golf club head in accordance with the fifth embodiment of the present invention includes a main body 10, a striking plate 11, an opening 12, a neck portion 13, a ring frame 14 and a weight 15. In comparison with the first through fourth embodiments, the weight 15 of the fifth embodiment is provided with a compartment 153 which is adapted to correspond to the sweet spot of the striking plate 11 when assembled. Thereby, the compartment 153 is able to allow deformation of the striking plate 11 during striking a golf ball.

Figure 12:
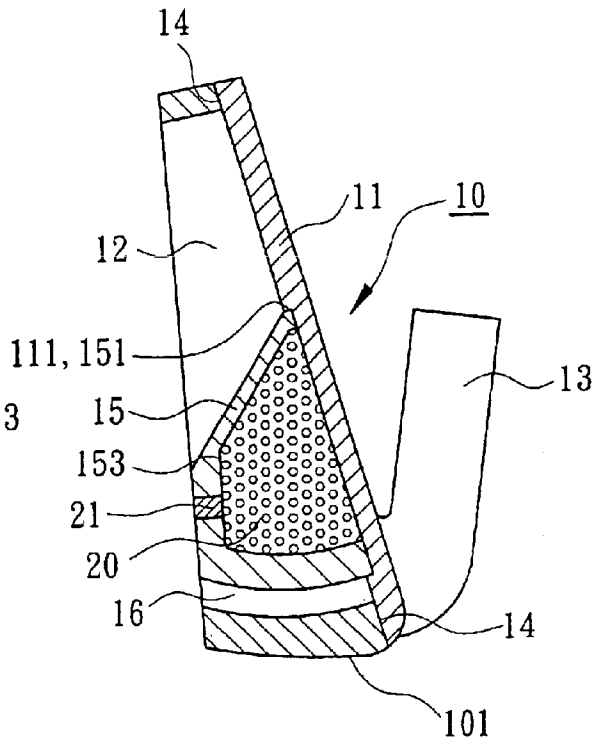
FIG. 12 is a cross-sectional view of a golf club head in accordance with a sixth embodiment of the present invention.

Referring to FIG. 12, the golf club head in accordance with the sixth embodiment of the present invention includes a main body 10, a striking plate 11, an opening 12, a neck portion 13, a ring frame 14 and a weight 15. In comparison with the fifth embodiment, the weight 15 of the sixth embodiment is provided with a compartment 153 and an aperture (not labeled) connected thereto. The aperture is adapted to inject a damping material 20 which may be selected from a group consisting of epoxy, rubber, latex, foaming material, fluid, colloid, and other vibration-absorbable material. The aperture is sealed by a sealing member 21 in place after the compartment 153 is filled with the damping material 20. During striking a golf ball, the damping material 20 may absorb vibration and the compartment 153, without affection of the damping material 20, may also allow deformation of the striking plate 11. Thereby, the golf club head of the present invention accomplishes excellent absorbability for vibration and various design choices for adjusting a center of gravity.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A golf club head, comprising:

a striking plate including a rear surface and recession formed thereon;

a weight engaged with the recession proximate to a bottom edge of the striking plate, said weight including a top portion and a bottom portion;

a main body including a ring frame adapted to connect with the striking plate; and an elongated gap formed between the sole plate of the main body and the bottom portion of the weight located on the rear surface of the striking plate.

2. The golf club head as defined in claim 1, wherein the elongated gap and the weight are commonly extended along the sole plate from a toe end to a heel end.

3. The golf club head as defined in claim 1, wherein the elongated gap has a width in a range of 0.5 to 8.0 mm.

4. The golf club head as defined in claim 1, wherein the weight has a maximum thickness substantially equal to or greater than 2.5 times of a thickness of the striking plate.

5. The golf club head as defined in claim 1, wherein the main body has a center of gravity and a distance thereof; the distance spaced apart from the sole plate is substantially equal to or less than 20 mm.

6. The golf club head as defined in claim 1, wherein the striking plate is provided with at least one protrusion formed in the recession; and the weight is also provided with at least one corresponding groove engaged therewith.

7. The golf club head as defined in claim 1, wherein the striking plate is provided with a stepped portion.

8. The golf club head as defined in claim 7, wherein the golf club head is provided with a complementary stepped portion adapted to engage with the stepped portion of the striking plate.

9. The golf club head as defined in claim 1, wherein the striking plate is provided with a compartment.

10. The golf club head as defined in claim 9, wherein the compartment is filled with a damping material selected from the group consisting of epoxy, rubber, latex, foaming material, fluid, colloid, and other vibration-absorbable material.

11. The golf club head as defined in claim 1, wherein the bottom portion of the weight has a weight greater than that of the top portion to lower a center of gravity.

12. The golf club head as defined in claim 1, wherein said elongated gap has uniform thickness.

13. A golf club head comprising:

a striking plate including a rear surface and a recession formed thereon;

a weight engaged with the recession proximate to a bottom edge of the striking plate, said weight including a top portion and a bottom portion;

a main body including a ring frame adapted to connect with the striking plate, said main body including a sole plate, said weight is adapted to lower a center of gravity of said main body; and an elongated gap formed between the sole plate of the main body and the bottom portion of the weight located on the rear surface of the striking plate; and a neck portion.

* * * * *